United States Patent [19]

Lotane

[11] 4,095,376

[45] Jun. 20, 1978

[54] CLAMPING DEVICE FOR USE IN SHARPENING SHEARS AND THE LIKE

[76] Inventor: John H. Lotane, Morse Dr., Shelburne, Vt. 05432

[21] Appl. No.: 737,010

[22] Filed: Oct. 29, 1976

[51] Int. Cl.[2] ..... B24B 3/52

[52] U.S. Cl. ..... 51/218 R

[58] Field of Search ..... 51/218 R, 218 A; 269/196, 199, 274

[56] References Cited

U.S. PATENT DOCUMENTS

| | | | |
|---|---|---|---|
| 1,443,327 | 1/1923 | Tourtellot | 269/274 |
| 2,538,314 | 1/1951 | Johansson | 269/199 |
| 2,796,787 | 6/1957 | Aske | 269/274 |
| 3,855,738 | 12/1974 | Guggenheim | 269/196 |
| 4,005,553 | 2/1977 | Eller | 51/218 R |

FOREIGN PATENT DOCUMENTS

| | | | |
|---|---|---|---|
| 73,487 | 10/1916 | Switzerland | 51/218 A |

*Primary Examiner*—Harold D. Whitehead
*Attorney, Agent, or Firm*—Bacon & Thomas

[57] ABSTRACT

An improved clamping device for use in sharpening shears and the like with a grinding wheel wherein the shear blade is rigidly clamped onto a counterbalanced support member that is secured to a base member for free pivotal movement with respect thereto. The blade is clamped by a clamping assembly which includes a detachable spring-biased plate and a camming lever. The degree of free pivotal movement of the support member is adjustable for the purpose of presetting the desired grinding angle.

5 Claims, 4 Drawing Figures

CLAMPING DEVICE FOR USE IN SHARPENING SHEARS AND THE LIKE

BACKGROUND OF THE INVENTION

1. Field of the Invention

The present invention relates generally to work holders for securing a tool that is being worked upon by a machine or similar such device. More particularly, the present invention is directed to a device for clamping the blade of a shear or similar tool for sharpening by means of a grinding or abrasive wheel. Such clamping devices are normally provided with certain adjustability features to permit the adaptation of the device to the specific structural configuration and required grinding angle of the shear blade being sharpened.

2. Description of the Prior Art

The prior art is replete with various forms of work holders or clamping devices whereby knife blades, sharp tools or shear blades may be secured for sharpening by means of a grinding or abrasive wheel. These devices manifest different forms of clamping arrangements for securing the blade to be sharpened to the general body of the device itself, and also various forms of provisions for adjusting the angular disposition of the blade with respect to the grinding wheel for achieving the optimum grinding angle.

Such prior art devices may generally be classified into two broad groups. First, there are those independent, manually held and guided clamping devices which are not structurally associated or physically integral with the grinding wheel apparatus. Secondly, there are those clamping devices which are integrally or structurally associated with the grinding wheel apparatus such that their manner of use is limited specifically to the configuration and mounting arrangement of the grinding wheels with which they are associated.

The main problems characteristic of work holders or clamping devices for securing a shear or similar blade to be sharpened by a grinding wheel are based primarily upon the manner in which the blade is clamped onto the device and the manner in which the grinding angle of the blade is adjusted with respect to the position of the grinding wheel in accordance with the blade's individual structure. There have been many prior art attempts to provide for a clamping device whereby the blade to be sharpened can be easily and rigidly secured to the device without loosening or twisting of either the blade or clamp mechanism during the grinding operation. In addition, such known clamping devices have also assumed various configurations in attempts to adapt them to a variety of individual blade shapes. These prior art clamping devices, be they independent or structurally associated with a grinding apparatus, normally are only operable with very basic and simple shear blade configurations and do not permit the effective clamping and sharpening of more complex shear blade structures such as those having a serrated or "pinking" edge configuration. Such prior art clamping devices further do not permit a very rigid and secure clamping of the blade with the usual result being that the blade tends to move or twist, thereby destroying the precise grinding angle and position required for proper sharpeneing.

The critical problem of adjusting the precise required angle of the clamped blade with respect to the grinding wheel so that effective sharpening can be achieved is difficult to solve. Heretofore known devices manifest various forms of adjustment structures for achieving the desired grinding angle. However, the majority of these solutions are cumbersome, complex and expensive to produce. These devices are also almost invariably an integral part of the overall grinding apparatus since it has heretofore been difficult if not impossible to provide for an independent, manually operated clamping device which is both simple in structure and capable of precise grinding angle adjustment.

SUMMARY OF THE INVENTION

The clamping device of the present invention serves to overcome all the disadvantages and deficiencies inherent in the aforementioned known prior art devices. This is accomplished by providing for an improved clamping device which is in the form of an independent, manually held and operated unit that can be utilized with almost any known grinding or sharpening wheel apparatus. The clamping device of the invention includes a support member that is pivotally secured to a base member for free movement with respect thereto. The forward portion of the support member is structurally counterbalanced to pivot downwardly towards the grinding wheel. The rear portion of the support member is connected to the base member through an adjustment mechanism which permits the precise setting of the degree of free pivotal movement by the counterbalanced support member under the force of gravity, thereby setting the precise grinding angle. The shear blade is clamped upon the forward portion of the support member by a clamping assembly that includes a trapezoidal-shaped detachable clamping plate which has the shorter parallel side disposed adjacent an abutment formed in the support member to prevent twisting of the blade and subsequent loosening of the clamping plate due to the torque imposed upon the blade by the grinding wheel. The clamping plate is spring-biased away from the support member and pressed thereto by a camming lever mechanism which applies the necessary clamping force on the blade to be sharpened. The longer parallel side of the clamping plate is provided with an edge forming an acute angle with the horizontal plane of the plate, thereby permitting clearance room for the grinding wheel during extreme angular adjustments of the pivotal support member.

It is therefore an object of the present invention to provide for a manually operated work holder or clamping device for rigidly securing a shear blade or the like at any given desired angle for sharpening by an independent grinding wheel.

It is another object of the present invention to provide for a clamping device which is capable of rigidly and securely clamping a large variety of shear or similar blades of any given configuration for sharpening by a grinding wheel.

It is still another object of the present invention to provide for a clamping device for shears and the like which is extremely simple in structure and economical to manufacture.

It is yet another object of the present invention to provide for a clamping device which permits a rigid and secure clamping of a blade to be sharpened and the precise angular positioning of the blade with respect to the grinding wheel.

It is yet a further object of the present invention to provide for a clamping device wherein the precise grinding angle is achieved by a simple adjustment in conjunction with the force of gravity.

It is still yet another object of the present invention to provide for an independent, manually operated clamping device which can be adapted for use with a variety of grinding or sharpening wheel apparatus.

It is still yet a further object of the present invention to provide for a clamping device for shears and the like wherein the shear blade may be inserted and clamped within the device at any desired position without the possibility of the clamping mechanism being loosened by the torque imposed upon the blade during the grinding operation.

These and other objects of the present invention will be apparent from the following description and appended claims, reference being made to the accompanying drawings forming a part of this specification wherein like reference drawings designate corresponding parts in the several views.

BRIEF DESCRIPTION OF THE PREFERRED EMBODIMENT

The present invention is depicted in FIGS. 1–4. A clamping device 100 is shown to include a base member 103, a support member 105 carried by base member 103 for free pivotal movement with respect thereto, and a clamping assembly 107.

Figure 1:
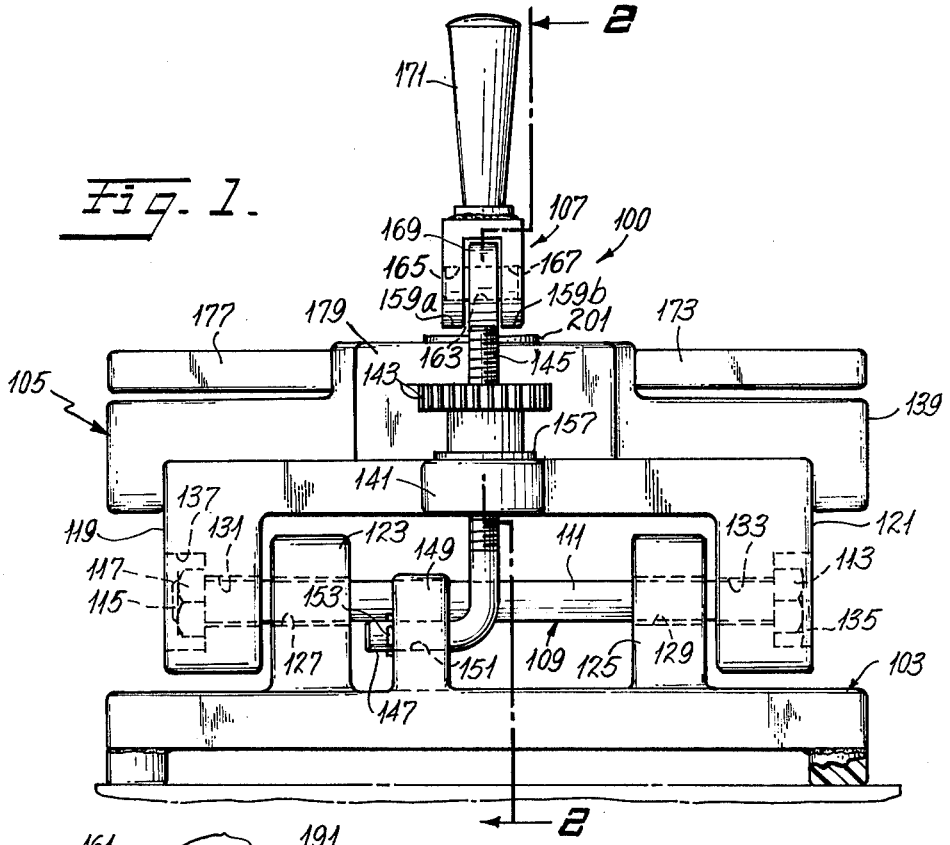
FIG. 1 is a rear elevational view partly in section, depicting the improved clamping device of the present invention.
Figure 2:
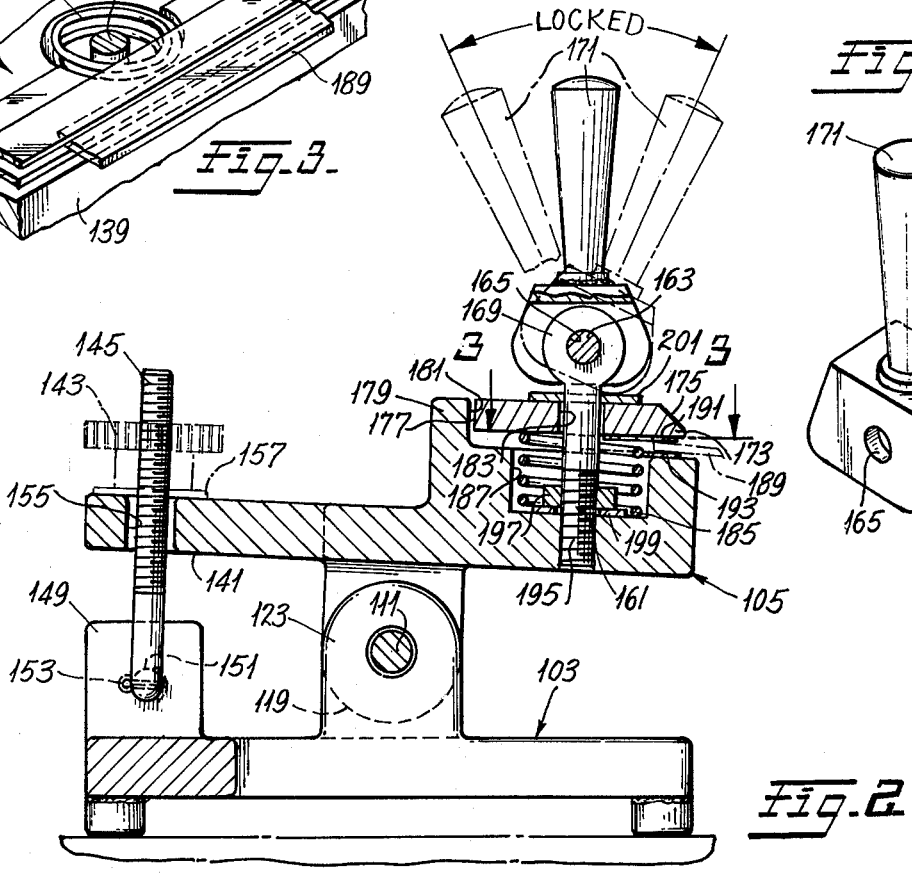
FIG. 2 is a vertical sectional view, taken along the line 2–2 of FIG. 1.

Referring to FIGS. 1 and 2, assembly 109 includes a shaft 111 having a bolt head 113 at one end and a threaded end 115 on which a nut 117 may be secured. Member 105 includes a pair of downwarly depending flanges 119 and 121. Member 103 is provided with a pair of upstanding flanges 123 and 125 disposed inwardly of flanges 119 and 121. A pair of coaxially aligned bores 127 and 129 are provided in flanges 123 and 125, respectively. Similarly, a pair of coaxially aligned bores 131 and 133 are provided in flanges 119 and 121, respectively. As is evident in FIG. 1, shaft 111 is freely journalled through bores 127, 129, 131 and 133, with head 113 and nut 117 extending beyond the outer ends of bores 131 and 133. A pair of enlarged recesses 135 and 137 are provided in the opposite end portions of member 105 for the purpose of accommodating head 113 and nut 117 in a countersunk manner. By virtue of this arrangement, member 105 is thus capable of free pivotal movement with respect to member 103.

Member 105 is also provided with a front portion 139 and a rear portion 141 disposed on opposite sides of the pivot axis defined by the longitudinal axis of shaft 111. The mass or weight of member 105 is controlled to dispose the majority thereof in front portion 139 so that the latter is always counterbalanced in a downward direction. In this manner, the pivotal axis as defined by shaft 111 is essentially disposed rearwardly of the center of gravity of member 105.

The degree of free pivotal movement of member 105 is controlled and limited by means of a thumb screw 143 which is threadedly attached to an L-shaped bolt 145. The latter includes a right angled unthreaded leg portion 147 which is pivotally secured to a third upstanding flange 149 provided on the upper surface of member 103. This is achieved by passing leg 147 through a bore 151 formed in flange 149 and securing leg 147 therein against removal by means of a cotter pin 153 or similar fastening means. The threaded portion of bolt 145 is passed through an oversized aperture 155 formed in rear portion 141 of member 105. A washer 157 is disposed between the lower portion of thumb screw 143 and the upper surface of rear portion 141. Since front portion 139 is counterbalanced in a downward direction, it is evident that by tightening or loosening thumb screw 143, the degree of free pivotal movement of member 105 can be controlled and limited as desired.

Clamping assembly 107 of device 100 is particularly characterized by a U-shaped cam member 159 which is pivotally secured to front portion 139 by means of an eye bolt 161. This is achieved by means of a lock pin 163 which is passed through a pair of aligned apertures 165 and 167 in the leg portions of member 159. Pin 163 also passes through an eye head 169 of bolt 167, which head 169 is disposed between the leg portions of member 159. Member 159 is provided with an upstanding actuation handle 171.

Figure 3:
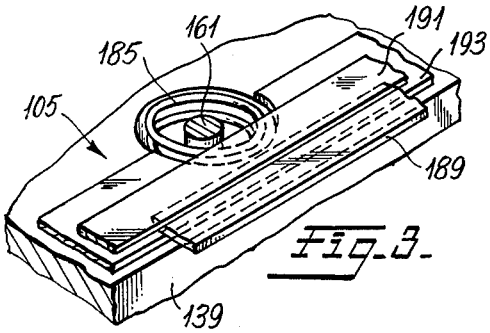
FIG. 3 is a fragmentary horizontal sectional view, taken along the line 3–3 of FIG. 2 and depicting gaskets for securing the blade in place for sharpening.

Device 100 includes a substantially trapezoidal shaped clamping plate 173 having a longer parallel side 175 in the form of an acute angle edge and a shorter parallel side 177. Front portion 139 is provided with a vertical flange 179 having a longitudinal wall section 181 which is essentially the same length as and parallel to side 177 of plate 173. Eye bolt 161 also serves to secure plate 173 in its position above the upper surface of portion 139 by being disposed through an aperture 183 formed in plate 173. A spring 185 disposed within a recess 187 formed in front portion 139 serves to bias plate 173 in an upward direction to thereby define a variable spacing between the lower portion of side 175 and the upper front surface of portion 139 for the purpose of securing a shear blade 189 therebetween. Referring to FIG. 3, it can be seen that gaskets 191 and 193 of resilient material, such as rubber or the like, may be disposed on the shear blade contact faces of plate 173 and the upper surface of portion 139 for the purpose of further assuring a secure frictional clamping of blade 189.

Bolt 161 is threadedly secured within threaded recess 195 of portion 139. A lock nut 197 and associated washer 199 are utilized to guard against accidental loosening or removal of bolt 161 during the sharpening operation. A second washer 201 is secured by bolt 161 and disposed between the lower portion of member 159 and the upper surface of plate 173.

Figure 4:
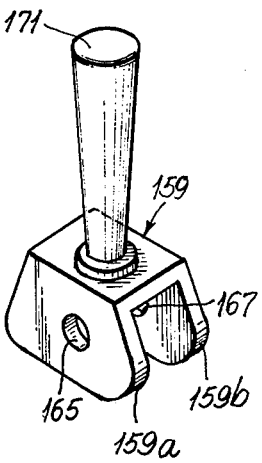
FIG. 4 is a perspective view of the handle utilized in effecting the clamping action of the camming lever for the clamping device of FIGS. 1–3.

Camming member 159, as also depicted in FIG. 4, is shown to include four camming surfaces **159*a*, 159*b*, 159*c* and 159*d*. As is apparent from FIG. 2, once shear blade 189 has been disposed between plate 173 and the associated upper surface of portion 139 and positioned therebetween as desired for the sharpening operation, plate 137 may then be pressed tightly downwardly upon blade 189 so that the latter is firmly gripped between gaskets 191 and 193. This is achieved by pivoting handle 171 in either the forward or rearward direction for a distance of approximately 25° from the longitudinal axis of bolt 161. This in turn causes the respective pairs of surfaces 159*a* and 159*b* or 159*c* and 159*d* to rotate about pin 163 and contact the upper surface of washer 201 and thereby tightly press plate 173 against blade 189. Continued movement of handle 171 then causes either pair of surfaces 159***a* and 159*b* or 159*c* and 159*d*, depending on which direction handle 171 is moved, to cam and lock themselves tightly down against washer 201 so that blade 189 is securely retained against movement. In this manner, the operator's hands are then freed to manipulate device 100 for the purpose of positioning blade 189 against the grinding wheel. Once the sharpening operation has been completed, blade 189 is removed by pivoting handle 171 back to its original position to thereby free plate 173 from the camming action of member 159. While member 159 is depicted as having two pairs of camming surfaces in order to facilitate the operation of assembly 107, notwithstanding the direction in which handle 171 is pivoted, it is to be understood that member 159 may also function with only one pair of surfaces, in which case actuation of member 159 can only be achieved by pivoting handle 171 in the one direction corresponding to such surfaces.

It is to be understood that the forms of the invention herewith shown and described are to be taken as preferred examples of the same, and that various changes in the shape, size and arrangement of parts may be resorted to without departing from the spirit of the invention or scope of the subjoined claims.

I claim:

1. An improved freely movable and manipulable clamping device for use in sharpening shear blades and the like with a grinding wheel, which device comprises:

(a) a base member;

(b) a support member pivotally carried by the base member for free and unbiased pivotal movement with respect thereto, wherein the pivot point of the support member is disposed rearwardly of the center of gravity thereof to thereby provide a forward portion that is counterbalanced in a downward direction;

(c) a clamping means carried by the forward portion of the support member, which clamping means includes:

(i) a flange having a longitudinal wall section, (ii) a detachable plate having a substantially trapezoidal configuration, wherein the shorter parallel side of the plate is disposed adjacent and parallel to the longitudinal wall of the flange and the longer parallel side overlaps the blade when the latter is in a clamped positon; and (iii) a camming means for applying pressure to the upper portion of the detachable plate to clamp the blade to the forward portion of the support member, which camming means includes:

1. a camming member having at least two opposed cam surfaces, and 2. means for rotating the camming member for selectively engaging either cam surface;

(d) means for adjustably limiting the degree of free and unbiased pivotal movement of the support member with respect to the base member to control the desired grinding angle between the blade edge and the grinding wheel, and (e) resilient means carried by the support member and detachable plate for frictionally securing the clamped blade against movement with respect to the clamping device during sharpening.

2. The device of claim 1 wherein (a) the camming member includes two pairs of opposed cam surfaces, and (b) the means for rotating the camming member includes a handle for engaging either pair of opposed cam surfaces.

3. The device of claim 1 wherein the camming means is pivotally carried by the forward portion of the support member by means of a threaded eye-bolt and lock pin.

4. The device of claim 1 wherein the means for adjustably limiting the degree of pivotal movement includes a threaded L-shaped bolt and thumb screw assembly for engaging the rearward portion of the support member.

5. The device of claim 1 wherein the resilient means includes gaskets for contacting the clamped blade.

* * * * *